US011221566B2

(12) United States Patent
Soda et al.

(10) Patent No.: US 11,221,566 B2
(45) Date of Patent: Jan. 11, 2022

(54) IMAGE FORMING APPARATUS CONTAINING A TONER SUPPLY BOTTLE HAVING A SINGLE BOTTLE BODY AND A SUPPLY UNIT PROVIDED NEAR ONE END OF THE BOTTLE BODY

(71) Applicant: Konica Minolta, Inc., Tokyo (JP)

(72) Inventors: Koji Soda, Toyokawa (JP); Yusuke Hashimoto, Anjo (JP); Naoki Nonoyama, Toyokawa (JP); Youichi Itagaki, Toyokawa (JP); Hitomi Kawata, Toyohashi (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 16/892,894

(22) Filed: Jun. 4, 2020

(65) Prior Publication Data

US 2020/0393777 A1 Dec. 17, 2020

(51) Int. Cl.
*G03G 15/08* (2006.01)
*G03G 15/01* (2006.01)
(Continued)

(52) U.S. Cl.
CPC ..... *G03G 15/0126* (2013.01); *G03G 15/0806* (2013.01); *G03G 15/0865* (2013.01);
(Continued)

(58) Field of Classification Search
CPC ..... G03G 15/0126; G03G 15/0806; G03G 15/556; G03G 15/0147; G03G 15/1605;
(Continued)

(56) References Cited

U.S. PATENT DOCUMENTS

2001/0009624 A1* 7/2001 Abe ..... G03G 15/0877 399/252
2002/0071694 A1* 6/2002 Sakai ..... G03G 15/0822 399/119

(Continued)

FOREIGN PATENT DOCUMENTS

EP 1413932 A2 * 4/2004 ..... G03G 15/0855
JP 2011-064778 A 3/2011
JP 2015-001638 A 1/2015

*Primary Examiner* — Walter L Lindsay, Jr.
*Assistant Examiner* — Laura Roth
(74) *Attorney, Agent, or Firm* — Lucas & Mercanti, LLP

(57) ABSTRACT

An image forming apparatus performs primary transfer of single-color toner image onto an intermediate transfer belt and performs secondary transfer of the toner image onto a sheet, and includes: single image forming unit forming the single-color toner image; single toner supply bottle containing replenishment toner; and first and second support members supporting the belt. The image forming unit is closer to the first member than the second member in a belt rotation direction. The bottle includes: single bottle body; and supply unit near one end of the body in the rotation direction. The other end is (i) closer to the second member than the one end is in the rotation direction and (ii) distant from the image forming unit in a support member direction from the first member toward the second member by one to three times a length of the image forming unit in the support member direction.

12 Claims, 9 Drawing Sheets

(51) Int. Cl.
*G03G 15/00* (2006.01)
*G03G 15/16* (2006.01)

(52) U.S. Cl.
CPC ..... *G03G 15/0875* (2013.01); *G03G 15/1605* (2013.01); *G03G 15/556* (2013.01)

(58) Field of Classification Search
CPC ..... G03G 15/0822; G03G 15/0865; G03G 15/0867; G03G 15/0872; G03G 15/087; G03G 15/0874; G03G 15/0875; G03G 15/0879; G03G 2215/066; G03G 2215/0663; G03G 2215/0665; G03G 2215/0668; G03G 2215/0675; G03G 2215/0167
See application file for complete search history.

(56) References Cited

U.S. PATENT DOCUMENTS

2003/0235440 A1* 12/2003 Takada ..... G03G 15/0131 399/302
2005/0100367 A1* 5/2005 Uratani ..... G03G 15/0875 399/254
2010/0046990 A1* 2/2010 Kamijo ..... G03G 15/1605 399/298
2013/0028638 A1* 1/2013 Tsuritani ..... G03G 15/0875 399/258
2015/0093154 A1* 4/2015 Yoshii ..... G03G 15/0875 399/263
2019/0377283 A1* 12/2019 Suzuki ..... G03G 15/161

* cited by examiner

IMAGE FORMING APPARATUS CONTAINING A TONER SUPPLY BOTTLE HAVING A SINGLE BOTTLE BODY AND A SUPPLY UNIT PROVIDED NEAR ONE END OF THE BOTTLE BODY

This application claims priority to Japanese Patent Application No. 2019-110902 filed Jun. 14, 2019, the contents of which are hereby incorporated herein by reference in their entirety.

BACKGROUND

Technological Field

The present disclosure relates to an image forming apparatus that performs primary transfer of a toner image of a single color onto an intermediate transfer belt that is running, and then performs secondary transfer of the toner image onto a sheet. The present disclosure relates particularly to improvement of a toner supply bottle for supplying replenishment toner to a single image forming unit that forms the toner image of the single color.

Description of the Related Art

Color image formation by tandem-type color image forming apparatuses including an intermediate transfer belt is performed as follows. Toner images of different colors, for example yellow (Y), magenta (M), cyan (C), and black (K) here, are formed by image forming units for Y, M, C, and K colors which are disposed in line in a rotation direction of the intermediate transfer belt. The toner images of Y, M, C, and K colors are primarily transferred onto the intermediate transfer belt so as to overlap one another. Then, the toner images of Y, M, C, and K colors, which have been multi-transferred onto the intermediate transfer belt, are secondarily transferred collectively onto a recording sheet. Thus, a color image is obtained.

In recent years, there has been proposed a method of applying design modification, namely, so-called minimal design, to such tandem-type color image forming apparatuses to obtain image forming apparatuses for forming toner images of a single color such as K color. According to this minimal design, members irrelevant to K-color toner image formation are mainly removed from color image forming apparatuses, such as image forming units for Y, M, and C colors and toner supply bottles for Y, M, and C colors for supply to the respective image forming units.

Such image forming apparatuses resulting from the minimal design employ an intermediate transfer system of an intermediate transfer belt as well as the color image forming apparatuses do, and accordingly have an improved sheet conveyance performance as well as the color image forming apparatuses do. The image forming apparatuses resulting from the minimal design also have no risk of transfer misalignment caused by vibration of a sheet in direct contact with a photoreceptor of an image forming unit, unlike image forming apparatuses employing a so-called direct transfer system of directly transferring toner images from a photoreceptor of an image forming unit onto a sheet. This also leads to improvement in image quality of K-color toner images.

The image forming apparatuses resulting from the minimal design have an empty space thereinside, corresponding to occupied spaces inside the color image forming apparatuses, specifically spaces for three toner supply bottles for Y, M, and C colors among four toner supply bottles for Y, M, C, and K colors disposed in a rotation direction of the intermediate transfer belt of the color image forming apparatuses. Japanese Patent Application Publications No. 2015-1638 and 2011-64778 disclose that such an empty space is used to dispose an additional K-color toner supply bottle to increase the number of K-color toner supply bottles, thereby increasing a K-color replenishment toner capacity.

SUMMARY

According to image forming apparatuses of Japanese application publications No. 2015-1638 and 2011-64778, however, K-color replenishment toner is supplied to a K-color image forming unit through conveyance paths provided for the respective K-color toner supply bottles. Specifically, for each K-color toner supply bottle, a conveyance path such as a pipe is provided such that replenishment toner ejected through an ejection outlet of each K-color toner supply bottle is conveyed to the K-color image forming unit.

In the case where multiple toner supply bottles are provided for a single image forming unit such as above, it is necessary to provide separate conveyance paths for the respective toner supply bottles and combine the conveyance paths together on the way to the image forming unit. This complicates the apparatus structure. Such a problem occurs not only in the case where the entire empty space is used to dispose additional toner supply bottles but also in the case where part of the empty space is used to do so.

The present disclosure aims to provide an image forming apparatus which includes a toner supply bottle having an increased capacity with a simple structure, to form single-color toner images by an intermediate transfer belt.

The above aim is achieved by an image forming apparatus that performs primary transfer of a toner image of a single color onto an intermediate transfer belt that is running, and then performs secondary transfer of the toner image onto a sheet, the image forming apparatus comprising: a single image forming unit that forms the toner image of the single color; a single toner supply bottle that contains replenishment toner for supply to the image forming unit; and a first support member and a second support member that are disposed inside a belt rotation path of the intermediate transfer belt, and support the intermediate transfer belt such that the intermediate transfer belt is rotatable. The image forming unit is disposed, outside the belt rotation path, closer to the first support member than the second support member in a belt rotation direction of the intermediate transfer belt. The toner supply bottle includes: a single bottle body; and a supply unit that is provided near one end of the bottle body in the belt rotation direction, and supplies the replenishment toner contained in the bottle body to the image forming unit. The other end of the bottle body in the belt rotation direction is positioned (i) closer to the second support member than the one end of the bottle body is in the belt rotation direction and (ii) distant from the image forming unit in a support member direction by one to three times a length of the image forming unit in the support member direction, the support member direction being from the first support member toward the second support member.

BRIEF DESCRIPTION OF THE DRAWINGS

The advantages and features provided by one or more embodiments of the disclosure will become more fully understood from the detailed description given hereinbelow and the appended drawings which are given by way of illustration only, and thus are not intended as a definition of the limits of the invention. In the drawings.

DETAILED DESCRIPTION OF EMBODIMENTS

Hereinafter, one or more embodiments of the present disclosure will be described with reference to the drawings. However, the scope of the invention is not limited to the disclosed embodiments.

The following describes an embodiment of an image forming apparatus relating to the present disclosure with use of an example of a monochrome printer (hereinafter, referred to simply as a printer).

[1] Overall Structure

Figure 1:
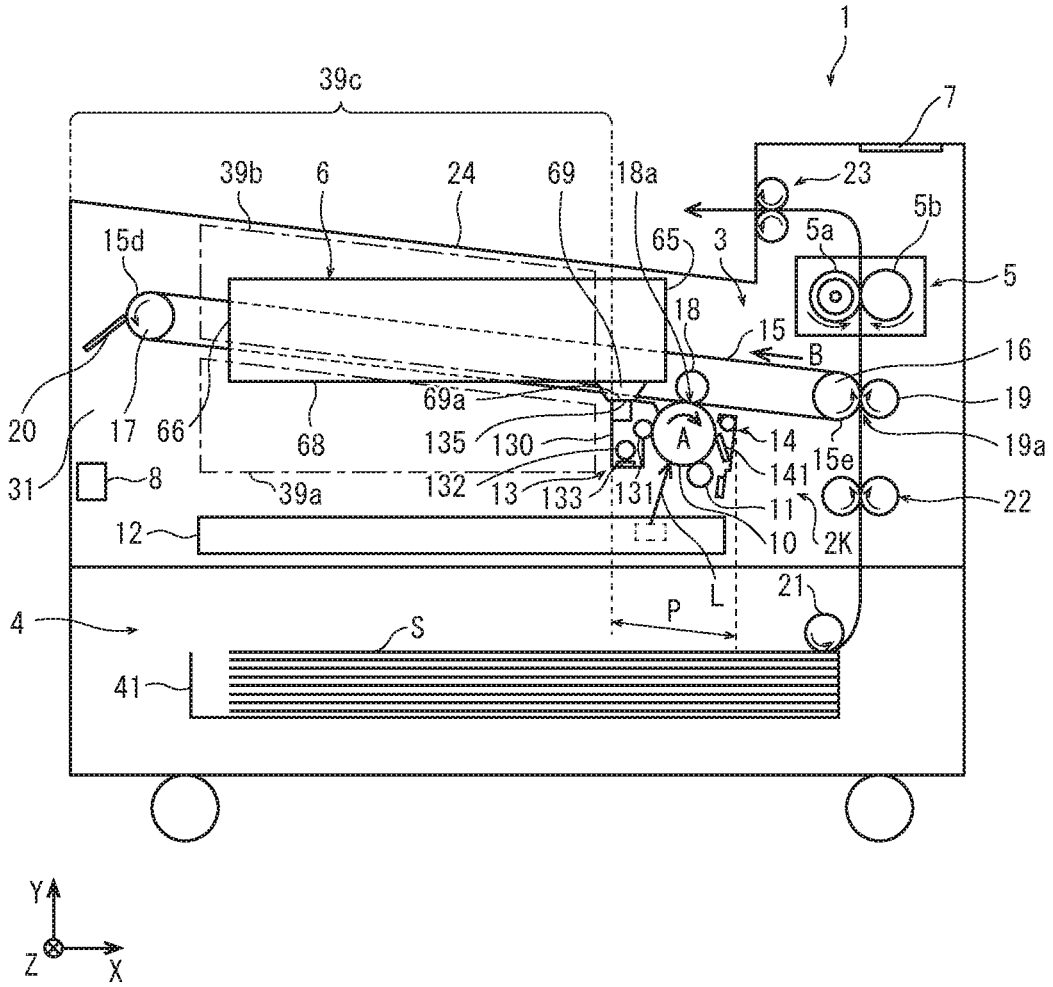
FIG. 1 is a schematic front view showing the overall structure of a printer relating to an embodiment.

FIG. 1 is a schematic front view showing the overall structure of a printer 1. The figure is drawn as if elements inside the printer 1 were seen through a front surface of an apparatus body 31 of the printer 1. In the figure, a lateral direction and a vertical direction when the printer 1 is viewed from the front are respectively represented as an X-axis direction and a Y-axis direction. Also, a depth direction perpendicular to both the X-axis and the Y-axis is represented as a Z-axis direction.

As shown in the figure, the printer 1 includes an image forming unit 2K for a single color, specifically a black (K) color here, an intermediate transfer unit 3, a feeding unit 4, a fixing unit 5, a toner supply bottle 6 containing K color replenishment toner, an operation display unit 7, an overall control unit 8, and so on. The single toner supply bottle 6 is provided for the single image forming unit 2K.

The printer 1 is connected to a network such as a LAN. In accordance with a print job execution instruction received from an external terminal device which is not illustrated, the printer 1 forms a K-color toner image and transfers the formed toner image onto a recording sheet S to obtain a monochrome image.

The image forming unit 2K includes a photoconductive drum 10 which rotates in a direction indicated by an arrow A, and further includes a charging unit 11, a developing unit 13, a cleaner 14, and so on which are disposed around the photoconductive drum 10. The image forming unit 2K forms a K-color toner image on the photoconductive drum 10.

Here, the developing unit 13 includes a housing 130 which contains two-component developer having K-color toner (not illustrated). Inside the housing 130, a developing roller 131 and a stirring screw 132 are provided. The developing roller 131 faces the photoconductive drum 10 and serves as a developer carrier which carries the developer. The stirring screw 132 serves as a stirring-conveying member which supplies the developer contained in the housing 130 to the developing roller 131 while stirring the developer. Furthermore, on a bottom of the housing 130, a developer density sensor 133 is provided for sensing a developer density indicating a density of toner relative to carrier in the two-component developer contained in the housing 130. This developer density represents an index value indicating an amount of toner in the developer contained in the developing unit 13. Note that although the photoconductive drum 10 serves as an image carrier in the above structure, a photosensitive belt may alternatively be used for example.

The intermediate transfer unit 3 includes an intermediate transfer belt 15 which is disposed above the image forming unit 2K, and further includes a driving roller 16 which is driven to rotate by a driving motor (not illustrated), a driven roller 17, a primary transfer roller 18, a secondary transfer roller 19, a cleaner 20, and so on.

The intermediate transfer belt 15 is an endless belt which is supported (tensioned) with a constant tension by the driving roller 16 positioned on one side in the lateral direction and the driven roller 17 positioned on the other side, so as to rotate to run in a direction indicated by an arrow B, namely, belt rotation direction.

Here, solid lines and broken lines in the figure indicating the intermediate transfer belt 15, which is tensioned by the rollers, represent a belt rotation path of the intermediate transfer belt 15. Inside this belt rotation path, the driving roller 16 (first support member), the driven roller 17 (second support member), and the primary transfer roller 18 are disposed. Outside the belt rotation path, the image forming unit 2K, the secondary transfer roller 19, and the cleaner 20 are disposed. Also, the developing unit 13 is disposed upstream of the photoconductive drum 10 in the belt rotation direction.

A first belt part 15*e* and a second belt part 15*d* of the intermediate transfer belt 15 are respectively wound around the driving roller 16 and the driven roller 17. In the present embodiment, the intermediate transfer belt 15 is kept slanted such that the second belt part 15*d* is higher than the first belt part 15*e* as shown in the figure. To keep this slant orientation of the intermediate transfer belt 15, the driving roller 16 and the driven roller 17 are rotatably supported at different levels in the vertical direction by the apparatus body 31 of the printer 1 as shown in the figure. Instead of being kept slanted as above, the intermediate transfer belt 15 may be tensioned so as to be horizontal for example by aligning positions of the driving roller 16 and the driven roller 17 in the vertical direction.

The primary transfer roller 18 is disposed facing the photoconductive drum 10 across the intermediate transfer belt 15. The secondary transfer roller 19 is disposed facing the driving roller 16 across the intermediate transfer belt 15.

Below the image forming unit 2K, an exposure unit 12 is provided. In accordance with a drive signal sent from the overall control unit 8, the exposure unit 12 emits, from light emitting elements included therein, optical beams L for K-color image formation.

The image forming unit 2K forms a K-color toner image as follows. The exposure unit 12 emits the optical beams L to scan the photoconductive drum 10 which is charged by the charging unit 11, such that an electrostatic latent image is formed on the photoconductive drum 10. The developing unit 13 develops the electrostatic latent image formed on the photoconductive drum 10 by the developer carried on the developing roller 131. Thus, a K-color toner image is formed on the photoconductive drum 10.

Toner supply control is performed such that when the developer density sensor 133 senses a decrease of K-color toner in the developing unit 13 due to K-color toner image formation, K-color replenishment toner is supplied from the toner supply bottle 6 to the developing unit 13. This toner supply control is described in detail later.

The K-color toner image, which has been formed on the photoconductive drum 10, is primarily transferred at a primary transfer position 18*a* onto the intermediate transfer belt 15 by the action of an electrostatic force imposed by the primary transfer roller 18. The primary transfer position 18*a* is a contact position on a circumferential surface of the photoconductive drum 10 in contact with the primary transfer roller 18 across the intermediate transfer belt 15. After the primary transfer, toner which has not been transferred onto the intermediate transfer belt 15 remains on the photoconductive drum 10. This residual toner is scraped by a cleaning blade 141 provided in the cleaner 14. The circumferential surface of the photoconductive drum 10 is thus cleared.

Owing to rotation of the intermediate transfer belt 15, the K-color toner image, which has been primarily transferred onto the intermediate transfer belt 15, reaches a secondary transfer position 19*a* where the secondary transfer roller 19 contacts the intermediate transfer belt 15.

The feeding unit 4 is provided in the lowest part of the printer 1, and includes a pickup roller 21 which picks up recording sheets S housed in a paper feed cassette 41 onto a conveyance path for conveyance to a pair of timing rollers 22 which is suspended.

The pair of timing rollers 22 starts rotating in accordance with a timing when the K-color toner image, which has been primarily transferred onto the rotating intermediate transfer belt 15, reaches the secondary transfer position 19*a*. The sheet S is thus conveyed to the secondary transfer position 19*a*.

While the sheet S passes through the secondary transfer position 19*a*, the K-color toner image, which has been primarily transferred onto the intermediate transfer belt 15, is secondarily transferred onto the sheet S by the action of an electrostatic force imposed by the secondary transfer roller 19. Thus, a K-color monochrome toner image is formed on the sheet S. After the secondary transfer, toner which has not been transferred onto the sheet S remains on the intermediate transfer belt 15. Upon reaching the driven roller 17 owing to rotation of the intermediate transfer belt 15, the residual toner is scraped by the cleaner 20 which is disposed facing the driven roller 17 across the intermediate transfer belt 15. Then, the residual toner thus removed is collected to a collection container which is not illustrated.

The sheet S, onto which the K-color toner image has been secondarily transferred at the secondary transfer position 19*a*, is conveyed to the fixing unit 5. The fixing unit 5 includes a heating roller 5*a* and a pressing roller 5*b* which form a fixing nip therebetween by pressure-contact with each other. While the sheet S conveyed from the secondary transfer roller 19 passes through the fixing nip, the fixing unit 5 thermally fixes the K-color toner image, which has been formed on the sheet S (unfixed image), onto on the sheet S by heat and pressure. After passing through the fixing unit 5, the sheet S is ejected outside by a pair of paper ejection rollers 23 which is disposed above the fixing unit 5, and thus is housed in a paper ejection tray 24 which is provided on a top part of the printer 1.

The toner supply bottle 6 is elongated and is disposed on a front side of the printer 1 (hereinafter, apparatus front side) relative to the intermediate transfer belt 15. The toner supply bottle 6 is removably mounted to a casing of the apparatus (apparatus body) 31. In the present embodiment, a mounting space (not illustrated) for mounting the toner supply bottle 6 is specifically provided inside the apparatus body 31. The mounting space has substantially the same height as the intermediate transfer belt 15 in the height direction of the printer 1, and is positioned on the apparatus front side relative to the intermediate transfer belt 15. Then, the toner supply bottle 6 is mounted in the mounting space.

The toner supply bottle 6 has a supply outlet 69*a* for replenishment toner. Meanwhile, the developing unit 13 has a receiving inlet 135 for replenishment toner. When the toner supply bottle 6 is mounted, the supply outlet 69*a* fits in the receiving inlet 135. With this structure, replenishment toner ejected through the supply outlet 69*a* is supplied to the inside of the housing 130 of the developing unit 13 through the receiving inlet 135.

On the apparatus front side, a front cover which is openable and closable is provided (not illustrated). A user opens and closes the front cover so as to replace the toner supply bottle 6 from the apparatus front side.

The operation display unit 7 is disposed at a position where the user in front of the printer 1 easily operates, specifically at a position on an upper surface of the apparatus body 31 on the apparatus front side. The operation display unit 7 includes a key for receiving a job execution instruction, a selection key for receiving selection of a job to be executed, and so on from the user. The operation display unit 7 also includes a display for displaying a screen relevant to jobs based on instructions from the overall control unit 8, an alert message which recommends the user to replace an empty toner supply bottle 6 with a new one, and so on.

Inside the printer 1, a region 39*a*, except the image forming unit 2K, between the intermediate transfer belt 15 and the exposure unit 12 is an empty space. This space region 39*a* exists because the tandem-type printer 1 is a monochrome printer obtained by applying minimal design to a color printer.

Specifically, the printer 1 is a black monochrome printer including only the image forming unit 2K for K color which is obtained by removing image forming units for Y, M, and C colors from a tandem-type color printer including image forming units for Y, M, C, and K color toner image formation. Thus, the region 39*a*, which is an empty space, in the printer 1 corresponds to a region of the color printer where the image forming units for Y, M, and C colors are disposed.

Also, the printer 1 has an increased toner capacity by expanding the toner supply bottle 6 in the region 39*b*, which corresponds to the region of the color printer where toner supply bottles for Y, M, and C colors are disposed for supplying replenishment toner of Y, M, and C colors to the image forming units for Y, M, and C colors. In other words, the printer 1, which results from the minimal design, includes the single image forming unit 2K and the single toner supply bottle 6 for the single image forming unit 2K, thereby to avoid complication of the apparatus structure caused by disposition of multiple toner supply bottles and also to increase the replenishment toner capacity.

[2] Structure of Toner Supply Bottle

Figure 2:
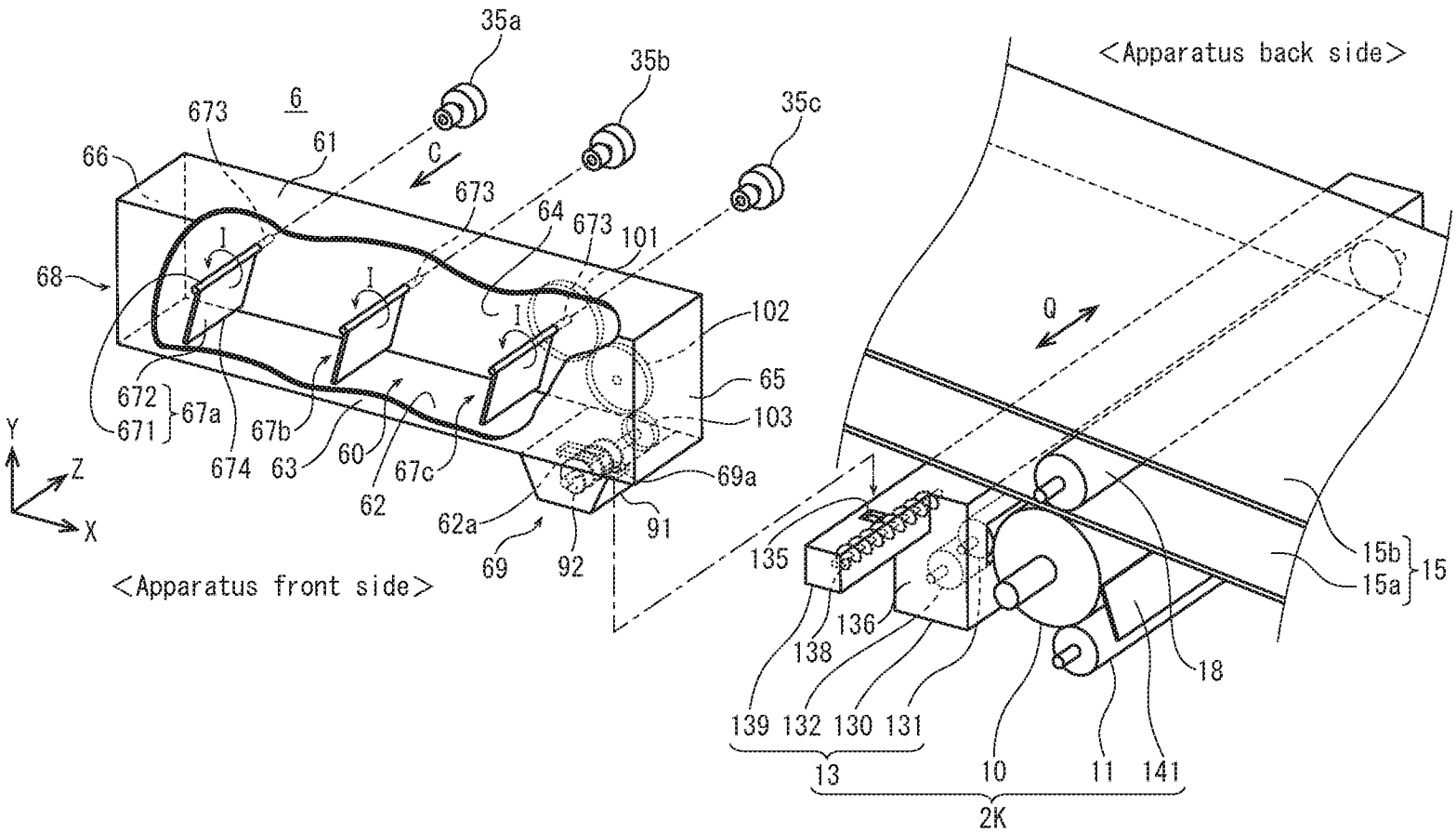
FIG. 2 is a schematic perspective view of a toner supply bottle.
Figure 3:
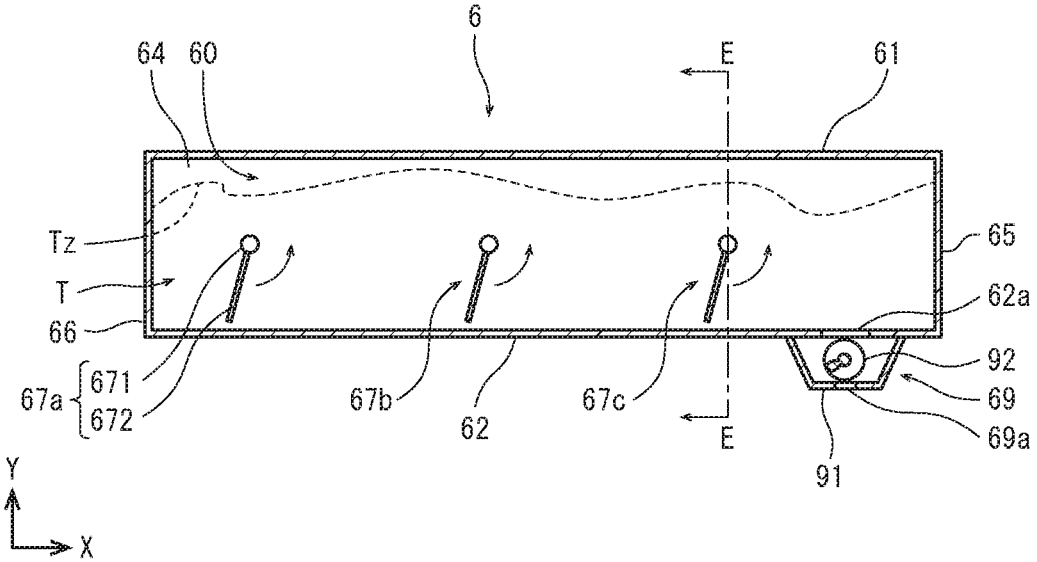
FIG. 3 is a longitudinal sectional view of the toner supply bottle.

FIG. 2 is a schematic perspective view of the toner supply bottle 6, and FIG. 3 is a longitudinal sectional view of the toner supply bottle 6. Here, FIG. 2 shows the internal structure of the toner supply bottle 6 by partially cutting the toner supply bottle 6, and also shows part of the structure of the image forming unit 2K which is a replenishment toner supply destination and the intermediate transfer unit 3. Also, respective parts of the intermediate transfer belt 15 which are positioned above and below the primary transfer roller 18 are indicated by numerical references 15*a* and 15*b*. In FIG. 3, a liquid level of contained toner T is indicated by reference Tz.

As shown in FIG. 2 and FIG. 3, the toner supply bottle 6 is a rectangular parallelepiped (box) container which is elongated in the X-axis direction, and has thereinside a container space 60 for replenishment toner T. The container space 60 is specifically surrounded by a top wall 61, a bottom wall 62, a front wall 63, a back wall 64, a right side wall 65, and a left side wall 66 in three directions, namely, the X-axis, Y-axis, and Z-axis directions. The walls 61-66 form a bottle body 68. This bottle body 68 is made of resin such as polystyrene (PS). Alternatively, other material may be used.

Near the right side wall 65 (one end in the belt rotation direction) of the bottle body 68, a supply room 69 is provided on a lower surface of the bottom wall 62. This supply room 69 serves as a supply unit for ejecting replenishment toner for supply to the developing unit 13.

The replenishment toner contained in the bottle body 68 flows into the supply room 69 through a through-hole 62*a* provided in the bottom wall 62. After flowing into the supply room 69, the replenishment toner is conveyed by a supply screw 92 (later described) provided in the supply room 69 from the apparatus front side toward a back side of the printer 1 (hereinafter, apparatus back side). Thus, the replenishment toner reaches the supply outlet (ejection outlet) 69*a* provided in a bottom wall 91 of the supply room 69, and is ejected through the supply outlet 69*a*.

The replenishment toner, which has been ejected through the supply outlet 69*a*, enters the toner receiving inlet 135 provided in a toner supply path 139. The toner supply path 139 extends from a front wall 136 of the housing 130 included in the developing unit 13 toward the apparatus front side, and communicates with an internal space of the housing 130. In this way, the replenishment toner is supplied from the toner supply bottle 6 to the developing unit 13.

Inside the toner supply path 139, a supply screw 138 having a spiral blade is inserted. The supply screw 138 is indicated by broken lines in the figure. Owing to rotation of this supply screw 138, the replenishment toner, which has entered the toner supply path 139 through the toner receiving inlet 135, is conveyed on the toner supply path 139 from the apparatus front side toward the apparatus back side. The replenishment toner, which is conveyed on the toner supply path 139, enters the housing 130 to reach the stirring screw 132. Then, the replenishment toner is stirred and conveyed by the stirring screw 132.

Inside the bottle body 68, three toner conveyance members 67*a*, 67*b*, and 67*c* are disposed at intervals in a space on the left of a position corresponding to the through-hole 62*a*.

The three toner conveyance members 67*a* to 67*c* are identical to one another in terms of shape, size, and material. The three toner conveyance members 67*a* to 67*c* each include a rotational shaft 671 which is parallel to the Z-axis direction, and a rectangular blade or paddle 672 which is fixed to the rotational shaft 671 and rotates about a shaft center of the rotational shaft 671 in a direction indicated by an arrow I in the figure. The toner conveyance members are hereinafter referred to as rotational blades or paddles. For each of the rotational blades or paddles 67*a* to 67*c*, the length from the rotational shaft 671 to a leading edge 674 of the blade or paddle 672 is designed such that the leading edge 674 is brought into abutment with the bottom wall 62 during rotation of the rotational blade or paddle.

When the rotational blades 67*a* to 67*c* rotate in the direction indicated by the arrow I, a conveyance force toward the right direction indicated by an arrow X, namely, a direction toward the through-hole 62*a*, is applied to the replenishment toner which is in abutment with the blades 672. Thus, the replenishment toner is conveyed toward the supply room 69, which is provided near the right side wall 65.

For each of the rotational blades 67*a* to 67*c*, the rotational shaft 671 is rotatably supported by the bottle body 68 and has an end part 673 on the apparatus back side. The end part 673 protrudes outwardly from the bottle body 68 through the back wall 64. The respective end parts 673 of the rotational shafts 671 of the rotational blades 67*a* to 67*c* are coupled to supply motors 35*a* to 35*c*. Upon receiving respective rotation driving forces of the supply motors 35*a* to 35*c*, the rotational blades 67*a* to 67*c* rotate in the direction indicated by the arrow I. Since the three rotational blades 67*a* to 67*c* one-to-one correspond to the three supply motors 35*a* to 35*c*, the rotational blades 67*a* to 67*c* rotate separately and independently. The supply motors 35*a* to 35*c* have the identical performance.

Among the three rotational blades 67*a* to 67*c*, the rotational blade 67*c* is the closest to the supply room 69. A gear 101 is fixed to the end part 673 of the rotational shaft 671 of the rotational blade 67*c*. The gear 101 is indicated by broken lines in the figure because of being provided outside the back wall 64.

The gear 101 meshes, via a gear 102, with a gear 103 which is fixed to a rotational shaft of the supply screw 92, such that the supply screw 92 rotates in synchronization with the rotational blade 67*c*. In other words, part of the rotation driving force of the rotational blade 67*c* is used for rotating the supply screw 92. The following describes this driving mechanism with reference to FIG. 4 to FIG. 6.

Figure 4:
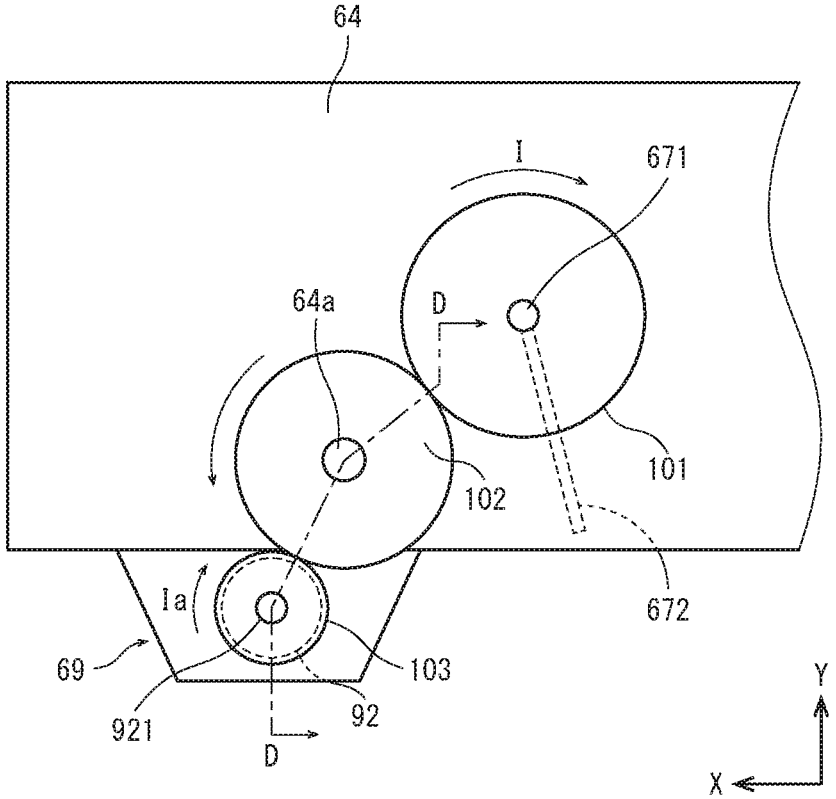
FIG. 4 is a rear view of gears provided in line on an outer surface of a rear wall of the toner supply bottle, seen from a direction indicated by an arrow C in FIG. 2.
Figure 5:
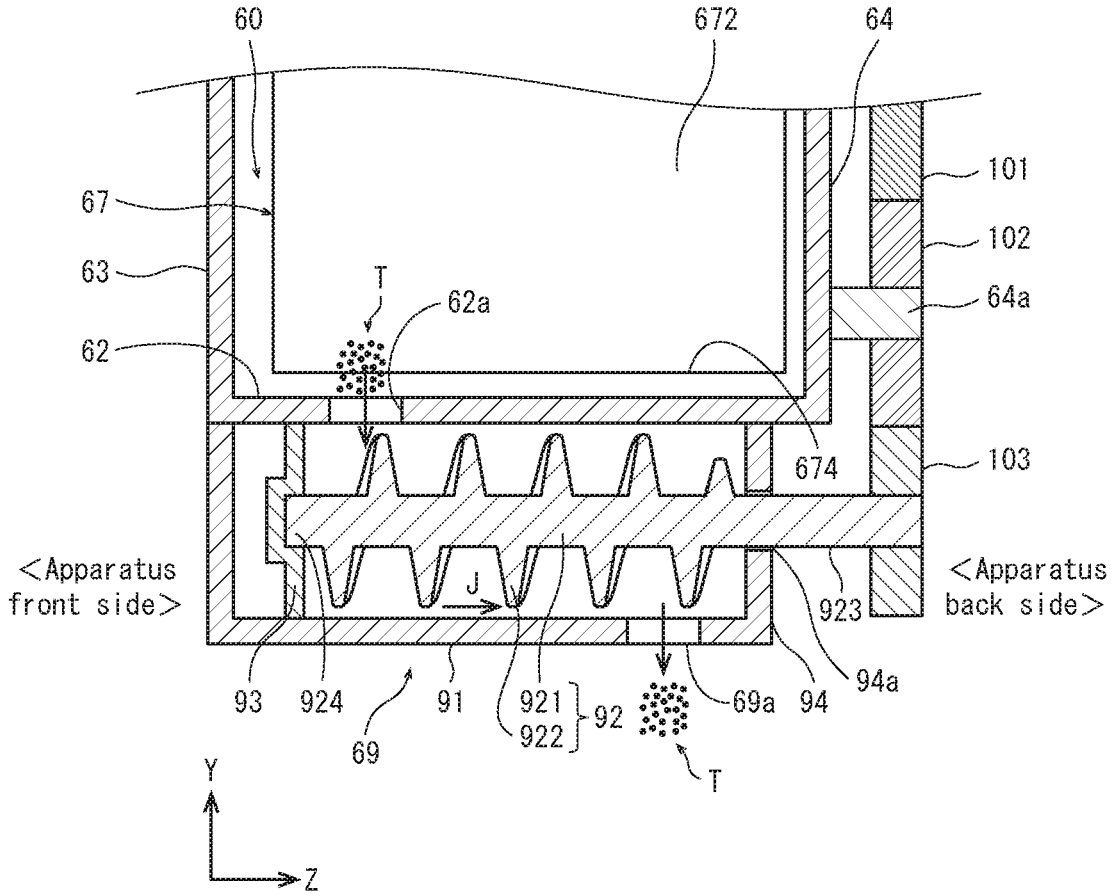
FIG. 5 is a cross-sectional view cut along a line D-D in FIG. 4.
Figure 6:
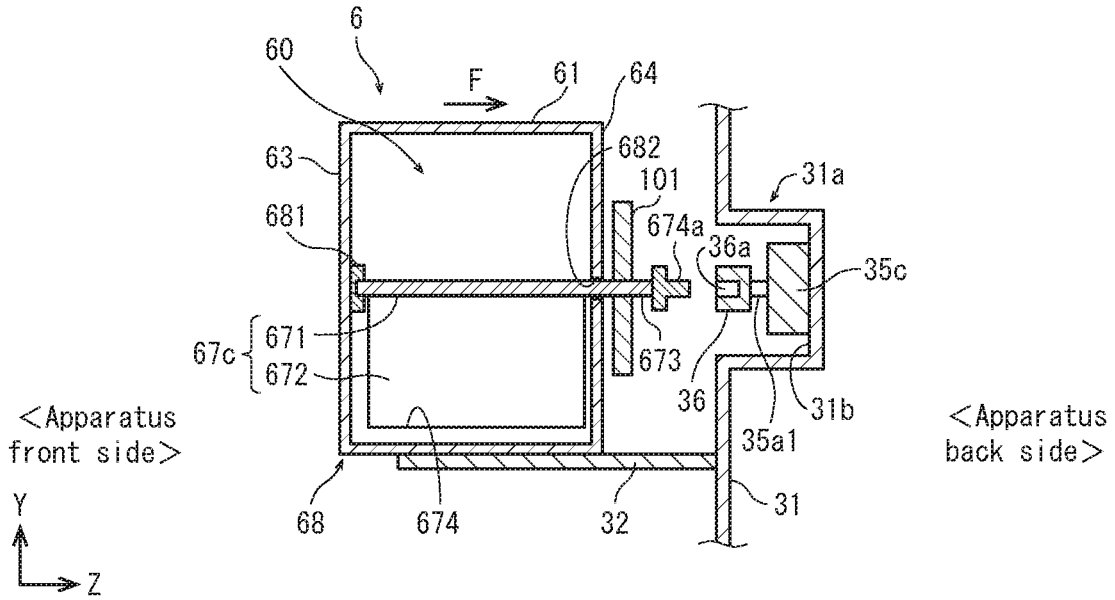
FIG. 6 is a cross-sectional view cut along a line E-E in FIG. 3.

FIG. 4 is a rear view of the gears 101 to 103 provided in line seen from a direction indicated by an arrow C in FIG. 2. FIG. 5 is a cross-sectional view cut along a line D-D in FIG. 4. FIG. 6 is a cross-sectional view cut along a line E-E in FIG. 3.

As shown in FIG. 4 and FIG. 5, the gear 102 is rotatably supported by a support shaft 64*a* provided on the back wall 64 of the toner supply bottle 6, and is disposed between the gear 101, which is fixed to the rotational shaft 671 of the rotational blade 67*c*, and the gear 103, which is fixed to the rotational shaft 921 of the supply screw 92 in the supply room 69. In FIG. 4, when the gear 101 rotates clockwise in the direction indicated by the arrow I, the gear 103 rotates clockwise in a direction indicated by an arrow Ia via the gear 102, and the supply screw 92 accordingly rotates in the same direction.

As shown in FIG. 5, the supply screw 92 is a conveyance member including the rotational shaft 921 which is elongated in an apparatus front-back direction (Z-axis direction) and a spiral blade 922 which is wound around the rotational shaft 921. The rotational shaft 921 has an end part 923 on the apparatus back side and an end part 924 on the apparatus front side. The supply screw 92, except the end part 923 of the rotational shaft 921, is housed inside the supply room 69.

The end part 924 of the rotational shaft 921, which is positioned on the apparatus front side, is rotatably supported by a front wall 93 of the supply room 69. Meanwhile, the end part 923 of the rotational shaft 921, which is positioned on the apparatus back side, protrudes outwardly from the supply room 69 via a through-hole 94*a* provided in a back wall 94 of the supply room 69, and has the gear 103 fixed thereto.

The spiral blade 922 is wound in a predefined winding direction, such that when the rotational shaft 921 rotates in the direction indicated by the arrow Ia in FIG. 4, a conveyance force toward a direction indicated by an arrow J is applied to toner contained in the supply room 69.

Owing to rotation of the rotational blade 67*c*, the replenishment toner T contained in the bottle body 68 is conveyed toward the supply room 69. Upon reaching the through-hole 62*a* which is an entrance for toner to the supply room 69, the replenishment toner T enters the supply room 69 through the through-hole 62*a*. After entering the supply room 69, the replenishment toner T is conveyed toward the direction indicated by the arrow J by the supply screw 92, which rotates simultaneously with the rotational blade 67*c*. Upon reaching the supply outlet 69*a* in the bottom wall 91, the replenishment toner T is ejected out of the supply room 69, that is, out of the toner supply bottle 6, through the supply outlet 69*a*. Thus, the replenishment toner T is supplied to the developing unit 13 through the toner receiving inlet 135 thereof.

While the supply screw 92 stops and the spiral blade 922 accordingly does not rotate, the replenishment toner contained in the supply room 69 is not conveyed in the direction indicated by the arrow J and accordingly is not ejected through the supply outlet 69*a*. Also, the supply motor 35*c*, which serves as a rotation driving source for the rotational blade 67*c* and the supply screw 92, is controlled so as to rotate only when the amount of toner contained in the developing unit 13 falls below a threshold value and to stop in other periods. With this structure, replenishment toner cannot be supplied to the developing unit 13 when the amount of toner contained in the developing unit 13 equals or exceeds the threshold value.

The following describes a mechanism for coupling the rotational blade 67*c* and the supply motor 35*c* with reference to FIG. 6. As shown in FIG. 6, the rotational shaft 671 of the rotational blade 67*c* is rotatably supported, at an end part thereof on the apparatus front side, by a support part 681 provided in an inner surface of the front wall 63. Also, the rotational shaft 671 protrudes outwardly, at the end part 673 thereof on the apparatus back side, from the bottle body 68 through a through-hole 682 provided in the back wall 64. The gear 101 is fixed to this end part 673. At the tip of the end part 673, a D-cut shaft part 674*a* with a D-shaped cross section is provided.

The supply motor 35*c* is provided in the apparatus body 31 such that a rotational shaft 35*a*1 of the supply motor 35*c* is mounted to a side surface 31*b* of a convex part 31*a* which is convex toward the apparatus back side. At the tip of the rotational shaft 35*a*1 of the supply motor 35*c*, a coupling 36 is provided. The coupling 36 has a D-cut hole 36*a* into which the D-cut shaft part 674*a* fits. This fitting transmits the rotation driving force of the supply motor 35*c* to the rotational shaft 671 of the rotational blade 67*c*.

Also, a guide 32 is provided in the apparatus body 31. The guide 32 is for facilitating the toner supply bottle 6 to slide in the Z-axis direction for replacement. To mount a new toner supply bottle 6 for example, a user opens the front cover, places the toner supply bottle 6 on the guide 32, and pushes the toner supply bottle 6 on the guide 32 from the apparatus front side toward the apparatus back side in a direction indicated by an arrow F. This push causes the D-cut shaft part 674*a* of the rotational blade 67*c* in the toner supply bottle 6 to fit into the D-cut hole 36*a* of the supply motor 35*c*. The user cannot further push the toner supply bottle 6 and accordingly finds that the toner supply bottle 6 has been pushed firmly. The user closes the front cover to complete mounting of the toner supply bottle 6 to the apparatus body 31.

When the supply motor 35*c* rotates with the toner supply bottle 6 mounted to the apparatus body 31, the rotation driving force of the supply motor 35*c* is transmitted to the rotational blade 67*c* and the gear 101, which is fixed to the rotational shaft 671 of the rotational blade 67*c*. This rotates the rotational blade 67*c* and the supply screw 92 simultaneously.

When the toner supply bottle 6 becomes empty, the user opens the front cover and holds the toner supply bottle 6 by hand to pull the toner supply bottle 6 toward the apparatus front side, thereby to cancel the fitting to remove the toner supply bottle 6 from the apparatus body 31.

Although the above description has been made on the rotational blade 67*c*, the same description applies to the rotational blades 67*a* and 67*b*. Specifically, switch between transmission and block of the respective rotation driving forces of the supply motors 35*a* and 35*b* to the rotational blades 67*a* and 67*b* is performed by switching between fitting of the D-cut shape part into the D-cut hole and cancellation of the fitting. Unlike the rotational blade 67*c*, the rotational blades 67*a* and 67*b* do not transmit their rotation driving forces to the supply screw 92 in the supply room 69. Thus, the gear 101 is not fixed to the rotational shafts 671 of the rotational blades 67*a* and 67*b*. The structure of the rotational blades 67*a* and 67*b* is equal to the structure of the rotational blade 67*c* from which the gear 101 is removed in FIG. 6.

The following describes an effect exhibited by the use of the toner supply bottle 6.

Figure 7:
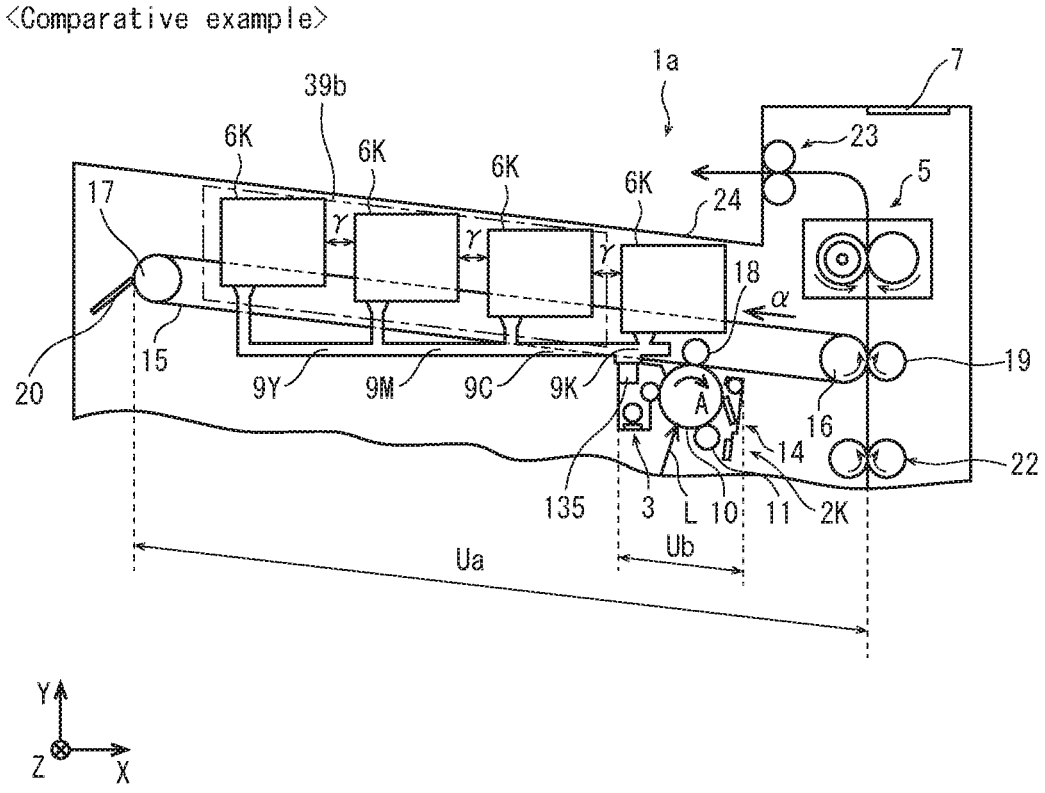
FIG. 7 illustrates the structure of a printer relating to a comparative example.

FIG. 7 illustrates the structure of a printer 1*a* relating to a comparative example relative to the printer 1 relating to the present embodiment. Like the printer 1, the printer 1*a* relating to the comparative example is a K-color monochrome printer obtained by applying minimal design to a color printer. In the figure, the same compositional elements as those of the printer 1 in FIG. 1 have the same referential numerals as those in FIG. 1.

As shown in FIG. 7, the printer 1*a* relating to the comparative example includes four toner supply bottles 6K which are disposed at intervals $\gamma$ in a direction $\alpha$ from the driving roller 16 toward the driven roller 17 (hereinafter, referred to as support member direction). The intermediate transfer belt 15 has a length Ua in the support member direction which is of course larger than a length Ub of the image forming unit 2K in the support member direction. Here, the length Ua is at least fourth times the length Ub. The same applies to the printer 1 in FIG. 1.

Among the four toner supply bottles 6K in FIG. 7, the three toner supply bottles 6K, except the one disposed on the right end, correspond to toner supply bottles for Y, M, and C colors included in the color printer before the minimal design.

With this structure of the printer 1*a* resulting from the minimal design, it is possible to avoid generation of empty spaces and effectively utilize a region elongated in the support member direction indicated by dash dotted lines 39*b*, which corresponds to a region of the color printer before the minimal design where the toner supply bottles for Y, M, and C colors are disposed. This increases the K-color replenishment toner capacity.

However, providing four toner supply bottles 6K complicates the internal structure of the apparatus as described in the above SUMMARY. Specifically, piping inside the apparatus is necessary. With respect to the respective toner supply bottles 6K, separate toner conveyance paths 9Y, 9M, 9C, and 9K such as pipes need to be provided for conveying replenishment toner to the single image forming unit 2K, and these toner conveyance paths need to be combined together on the way to the image forming unit 2K. Thus, the internal structure of the apparatus is complicated.

Compared with this, the printer 1 relating to the present embodiment in FIG. 1 includes the single toner supply bottle 6 for the single image forming unit 2K, and thus needs no piping inside the apparatus for multiple toner supply bottles, unlike in the comparative example where the multiple toner supply bottles 6K are included in FIG. 7. This avoids complication in apparatus structure.

Also, according to the toner supply bottle 6 relating to the present embodiment in FIG. 1, the supply room 69 is provided near the one end (the right side wall 65) of the bottle body 68 elongated in the support member direction. In addition, the bottle body 68 has the extended length in the support member direction such that the other end (the left side wall 66) is positioned inside a region 39*c* beyond the image forming unit 2K in the support member direction. The region 39*c* is positioned downstream of the image forming unit 2K in the support member direction.

Since the bottle body 68 is expanded so as to enter the region 39*c*, the toner supply bottle 6 has an increased capacity with an increased K-color replenishment toner capacity accordingly. Here, the length of the bottle body 68 in the support member direction is larger than the sum of the lengths of the three toner supply bottles 6K in the support member direction, except the one disposed on the right end, relating to the comparative example.

According to the comparative example in FIG. 7, since the multiple toner supply bottles 6K are provided, an interval γ is generated between each two adjacent toner supply bottles 6K. An empty space in the interval does not contribute to a container space for replenishment toner. According to the present embodiment, meanwhile, since the single toner supply bottle 6 is provided, no interval is generated unlike in the comparative example. Thus, the present embodiment achieves a lager replenishment toner capacity (volume) than the comparative example by the interval γ. In addition, according to the comparative example, as the thicknesses of side walls of each two adjacent toner supply bottles 6K increase, the capacity of the toner supply bottles 6K decreases. According to the present embodiment, meanwhile, since the single toner supply bottle 6 is provided, there is no side walls of adjacent toner supply bottles unlike in the comparative example. Thus, the present embodiment further has a larger replenishment toner capacity than the comparative example by the side walls of the adjacent toner supply bottles 6K.

[3] Structure of Overall Control Unit

Figure 8:
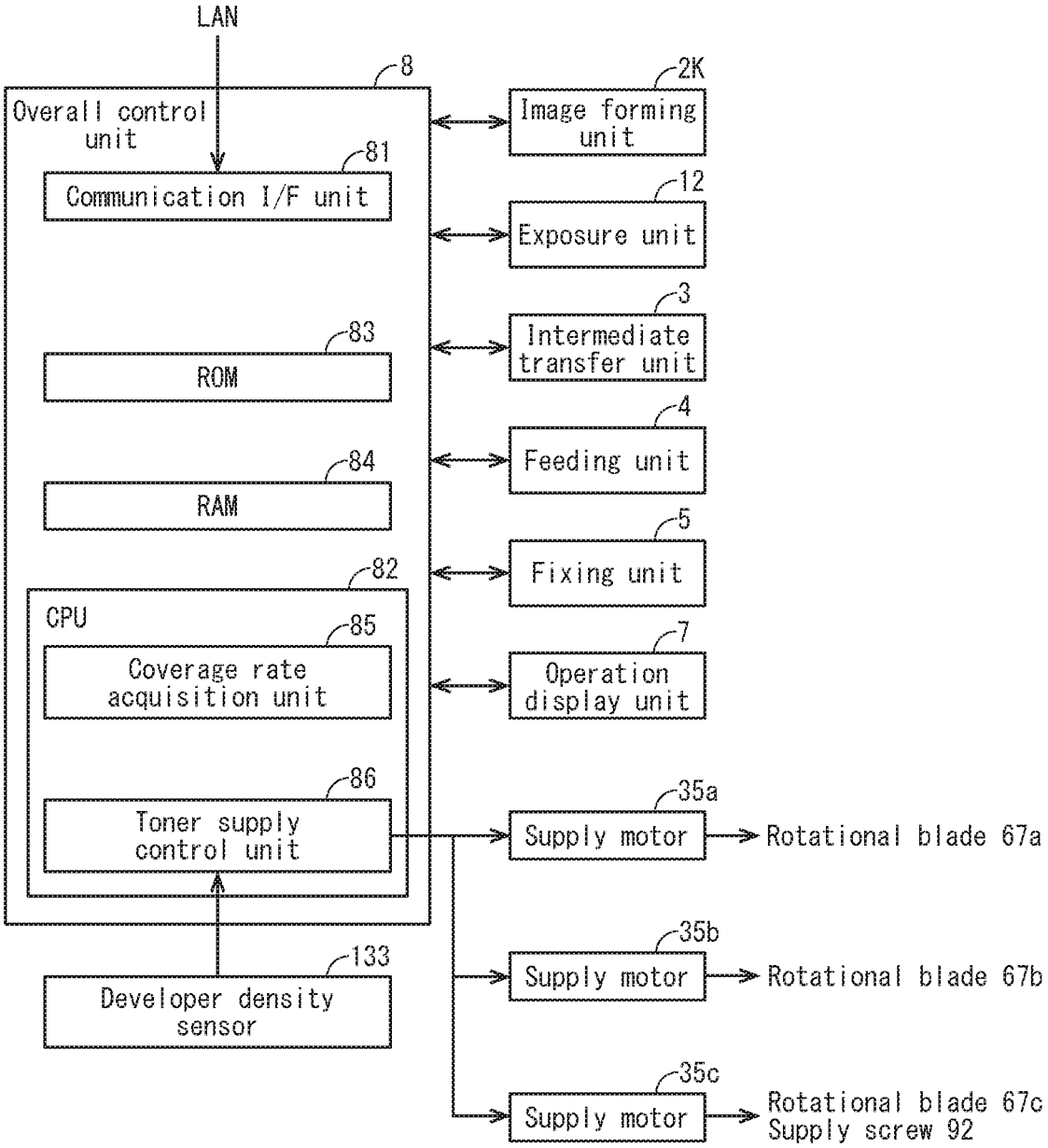
FIG. 8 is a block diagram showing the structure of an overall control unit.

FIG. 8 is a block diagram showing the structure of the overall control unit 8.

As shown in the figure, the overall control unit 8 includes a communication interface (I/F) unit 81, a CPU 82, a ROM 83, a RAM 84, and so on which are communicatable with one another.

The communication I/F unit 81 is an interface such as a LAN card and a LAN board for connecting to a network such as a LAN, and communicates with external terminal apparatuses connected thereto via the network.

The CPU 82 reads a necessary program from the ROM 83 and controls the image forming unit 2K, the exposure unit 12, the intermediate transfer unit 3, the feeding unit 4, and the fixing unit 5 for smooth print job execution. The RAM 84 is used as a work area for the CPU 82. The CPU 82 includes a coverage rate acquisition unit 85 and a toner supply control unit 86.

The coverage rate acquisition unit 85 acquires a coverage rate of a toner image to be formed for each print job. The coverage rate indicates an area ratio of a toner image to one sheet. In the case where information indicating the coverage rate is included in data of a print job, the coverage rate is acquired by reading the information. Also, the coverage rate in percentage is acquired in units of one sheet S by calculating (Sb/Sa)×100, where Sa represents the entire area of one sheet and Sb represents an area of a toner image to be formed.

Based on sensing results by the developer density sensor 133, the toner supply control unit 86 performs toner supply control, specifically controls the supply motors 35*a*, 35*b*, and 35*c* to supply replenishment toner from the toner supply bottle 6 to the developing unit 13 during a print job.

[4] Toner Supply Control

Figure 9:
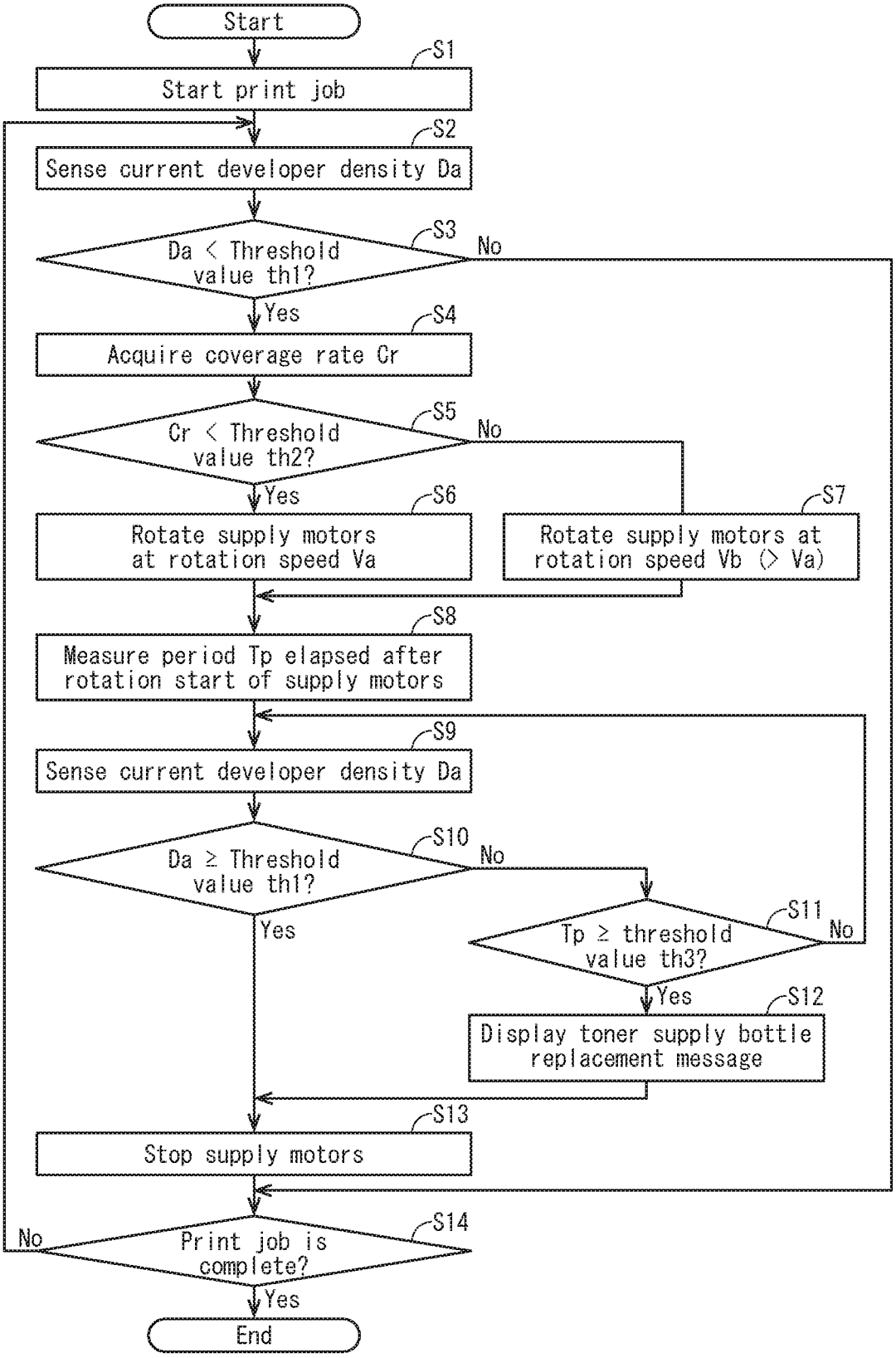
FIG. 9 is a flowchart showing operations of toner supply control.

FIG. 9 is a flowchart showing operations of the toner supply control.

As shown in the figure, upon start of a print job (Step S1), the toner supply control unit 86 senses a current developer density Da based on a sensing signal output from the developer density sensor 133 (Step S2). The toner supply control unit 86 judges whether the sensed developer density Da is less than a threshold value th1 (Step S3). Here, the threshold value th1 is a value for judging whether an amount of toner relative to carrier in a two-component developer currently contained in the developing unit 13 is appropriate for developing. The threshold value th1 has been preset through experiments for example.

When the toner supply control unit 86 judges the developer density Da≥the threshold value th1 (Step S3: No), supply of replenishment toner is regarded as being unnecessary and the flow proceeds to Step S14. Meanwhile, when the toner supply control unit 86 judges the developer density Da<the threshold value th1 (Step S3: Yes), supply of replenishment toner is regarded as being necessary and the flow proceeds to Step S4.

In Step S4, the toner supply control unit 86 acquires a coverage rate Cr from the coverage rate acquisition unit 85. The coverage rate Cr indicates a coverage rate of a toner image to be formed in a current print job.

In Step S5, the toner supply control unit 86 judges whether the acquired coverage rate Cr is less than a threshold value th2. Here, the threshold value th2 is a value for judging whether a supply amount of replenishment toner needs to be increased taking into consideration that a consumed amount of toner in a developing process of the print job among an amount of toner in the two-component developer contained in the developing unit 13 greatly differs depending on the value of the coverage rate Cr. The threshold value th2 has been preset through experiments for example.

Specifically, as the coverage rate Cr increases, a consumed amount of toner for one sheet increases in the developing process of the print job. Accordingly, the supply amount of replenishment toner cannot catch up with the consumed amount of toner, without increasing the supply amount of replenishment toner per unit time. To increase the supply amount of replenishment toner per unit time, the rotation speeds of the rotational blades 67*a* to 67*c* and the supply screw 92 need to be increased for the following reason.

By further increasing the rotation speeds of the rotational blades 67*a* to 67*c*, it is possible to further increase a conveyance amount of replenishment toner to the supply room 69, which is provided near the one end of the toner supply bottle 6 elongated in the support member direction, from the side of the other end. Also, by further increasing the rotation speed of the supply screw 92, it is possible to further increase an ejection amount per unit time of replenishment toner conveyed to the supply room 69 through the supply outlet 69*a*, thereby increasing the supply amount per unit time of replenishment toner to the developing unit 13.

To increase the rotation speeds of the rotational blades 67*a* to 67*c* and the supply screw 92, the respective rotation speeds of the supply motors 35*a* to 35*c* need to be increased.

In view of this, the present embodiment switches the rotation speeds of the supply motors 35*a* to 35*c* between two stages, i.e., a rotation speed Va and a rotation speed Vb which is higher than the rotation speed Va. Also, in the present embodiment, the rotation speed Va is determined such that a supply amount of replenishment toner per unit time exceeds an amount of toner in a print job consumed at a coverage rate Cr within a range of 0% to less than the threshold value th2.

Similarly, the rotation speed Vb (>Va) is determined such that the supply amount of replenishment toner per unit time exceeds the amount of toner in a print job consumed at the coverage rate Cr within a range of the threshold value th2 to 100%. It is true that the rotation speeds of the supply motors 35*a* to 35*c* can be uniformly determined to the higher rotation speed Vb irrespective of the coverage rate Cr. However, as the rotation speeds of the supply motors 35*a* to 35*c* increase, the rotational blades 67*a* to 67, which convey replenishment toner, put increased torque loads respectively on the supply motors 35*a* to 35*c*. This puts increased loads on the motors 35*a* to 35*c*. When no high-speed rotation is necessary, the rotation speeds of the supply motors 35*a* to 35*c* are decreased to the value Va such that reduced loads are put on the supply motors 35*a* to 35*c*. This leads to prolonged operation life of the supply motors 35*a* to 35*c* and power reduction compared with no decrease of the rotation speeds of the supply motors 35*a* to 35*c*. For this reason, the rotation speeds of the supply motors 35*a* to 35*c* are switched between the high and low speeds in the present embodiment.

When judging the coverage rate Cr<the threshold value th2 (Step S5: Yes), the toner supply control unit 86 drives the supply motors 35*a* to 35*c* to rotate at the rotation speed Va (Step S6) and the flow proceeds to Step S8. Meanwhile, when judging the coverage rate Cr≥the threshold value th2 (Step S5: No), the toner supply control unit 86 drives the supply motors 35*a* to 35*c* to rotate at the rotation speed Vb (Step S7) and the flow proceeds to Step S8. Thus, the replenishment toner starts to be supplied to the developing unit 13. This gradually increases the developer density Da of the two-component developer contained in the developing unit 13.

In Step S8, the toner supply control unit 86 measures a period Tp elapsed after rotation start of the supply motors 35*a* to 35*c*. This measurement is performed by a timer which is not illustrated.

Subsequently, in Step S9, the toner supply control unit 86 senses the current developer density Da based on a sensing signal output from the developer density sensor 133. When the toner supply control unit 86 judges the developer density Da≥the threshold value th1 (Step S10: Yes), supply of a necessary amount of replenishment toner is regarded as being complete. The toner supply control unit 86 thus stops the supply motors 35*a* to 35*c* (Step S13) and the flow proceeds to Step S14. In accordance with the stop of the supply motors, the period measurement by the timer is stopped and the timer is reset. The stop of the supply motors is equivalent to the rotation stop of the rotational blades 67*a* to 67*c* when the developer density Da≥the threshold value th1.

Meanwhile, when the toner supply control unit 86 judges the developer density Da<the threshold value th1 (Step S10: No), supply of replenishment toner is regarded as being still necessary to continue and the flow proceeds to Step S11. In Step S11, the toner supply control unit 86 judges whether or not the elapsed period Tp is a threshold value th3 or larger. The threshold value th3 indicates a period for judging whether the replenishment toner remains in the toner supply bottle 6, that is, whether the toner supply bottle 6 has become empty. The threshold value th3 has been preset to 30 seconds for example.

When the toner supply control unit 86 judges the elapsed period Tp<the threshold value th3 (Step S11: No), the flow returns to Step S9. Until the elapsed period Tp≥the threshold value th3 is satisfied, the processing of Steps S9, S10: No, and S11: No is repeatedly performed such that the developer density Da reaches the threshold value th1 by supply operations of replenishment toner.

When the toner supply control unit 86 judges the elapsed period Tp≥the threshold value th3 (Step S11: Yes), it is regarded that the developer density Da does not increase any more by further continuation of rotating the supply motors 35*a* to 35*c*, that is, the toner supply bottle 6 has become empty. Thus, the toner supply control unit 86 displays, on the operation display unit 7, a replacement message which recommends a user to replace the toner supply bottle 6 with a new one (Step S12), and the flow proceeds to Step S13. Note that when a new toner supply bottle 6 is mounted by the user's replacement work, the toner supply control unit 86 confirms mounting of the new toner supply bottle 6 by a sensor which is not illustrated or the user's manual registration. Upon this confirmation, the replacement message is deleted. In addition, the print job may be suspended along with display of the replacement message, and may be restarted along with deletion of the replacement message.

In Step S14, the toner supply control unit 86 judges whether the print job is complete. When the toner supply control unit 86 judges that the print job is not yet complete (Step S14: No), the flow returns to Step S2 and the subsequent processing is performed. When judging that print job is complete (Step S14: Yes), the toner supply control unit 86 ends the toner supply control.

In this way, it is possible to vary the supply amount of replenishment toner from the toner supply bottle 6 to the developing unit 13 depending on the coverage rate Cr. This enables the supply amount of replenishment toner to catch up with the consumed toner amount in print jobs irrespective of the coverage rate Cr, thereby achieving an appropriate and reliable supply of replenishment toner to the developing unit 13.

Although the rotation speeds of the supply motors are switched between the two stages i.e., the rotation speeds Va and Vb in the above description, the rotation speeds may alternatively be switched between three or more multiple stages. In such a switch control between multiple stages, a different threshold value is set for each stage.

[5] Modifications

The present disclosure has been described based on the embodiment above, but the present disclosure is of course not limited to the above embodiment and includes the following modifications.

(5-1) In the above embodiment, the exemplary structure has been described where the rotation speeds of the rotational blades 67*a* to 67*c* and the supply screw 92 are varied depending on the coverage rate Cr. Alternatively, the rotation speeds may be varied for example depending on the current amount of replenishment toner contained in the toner supply bottle 6 instead of the coverage rate Cr.

When a new toner supply bottle 6 has been just mounted, or when only quite a small amount of replenishment toner is supplied to the developing unit 13 after mounting of a new toner supply bottle 6, quite a large amount of replenishment toner is contained in the toner supply bottle 6. This clogs the toner supply bottle 6 with the replenishment toner and thus makes the replenishment toner difficult to flow inside the toner supply bottle 6. To address this situation, in the case where the rotational blades 67*a* to 67*c* are rotated at high speeds to apply a strong conveyance force to the replenishment toner, the replenishment toner tends to tighten. When particles of the tightened replenishment toner are for example pushed by a strong force against the side walls 63 to 66 of the toner supply bottle 6 and thus adhere to surfaces of these side walls, the rotational blades 67*a* to 67*c* cannot scrape the particles from the surfaces of the side walls. As a result, the replenishment toner might remain inside the bottle body 68 without being supplied to the developing unit 13.

In response to this problem, (a) when quite a large amount of replenishment toner is contained in the toner supply bottle 6, the rotation speeds of the rotational blades 67*a* to 67*c* need to be decreased to a certain extent to prevent replenishment toner from tightening. Since a large amount of replenishment toner is supposed to have been accumulated near the supply room 69, this decrease of the rotation speeds cannot cause excess decrease in supply amount of replenishment toner to the supply room 69.

(b) When the amount of replenishment toner decreases to the extent that the replenishment toner is prevented from tightening, the rotation speeds of the rotational blades 67*a* to 67*c* are switched to the higher values. This further increases the conveyance amount of replenishment toner per unit time to the supply room 69.

Figure 10:
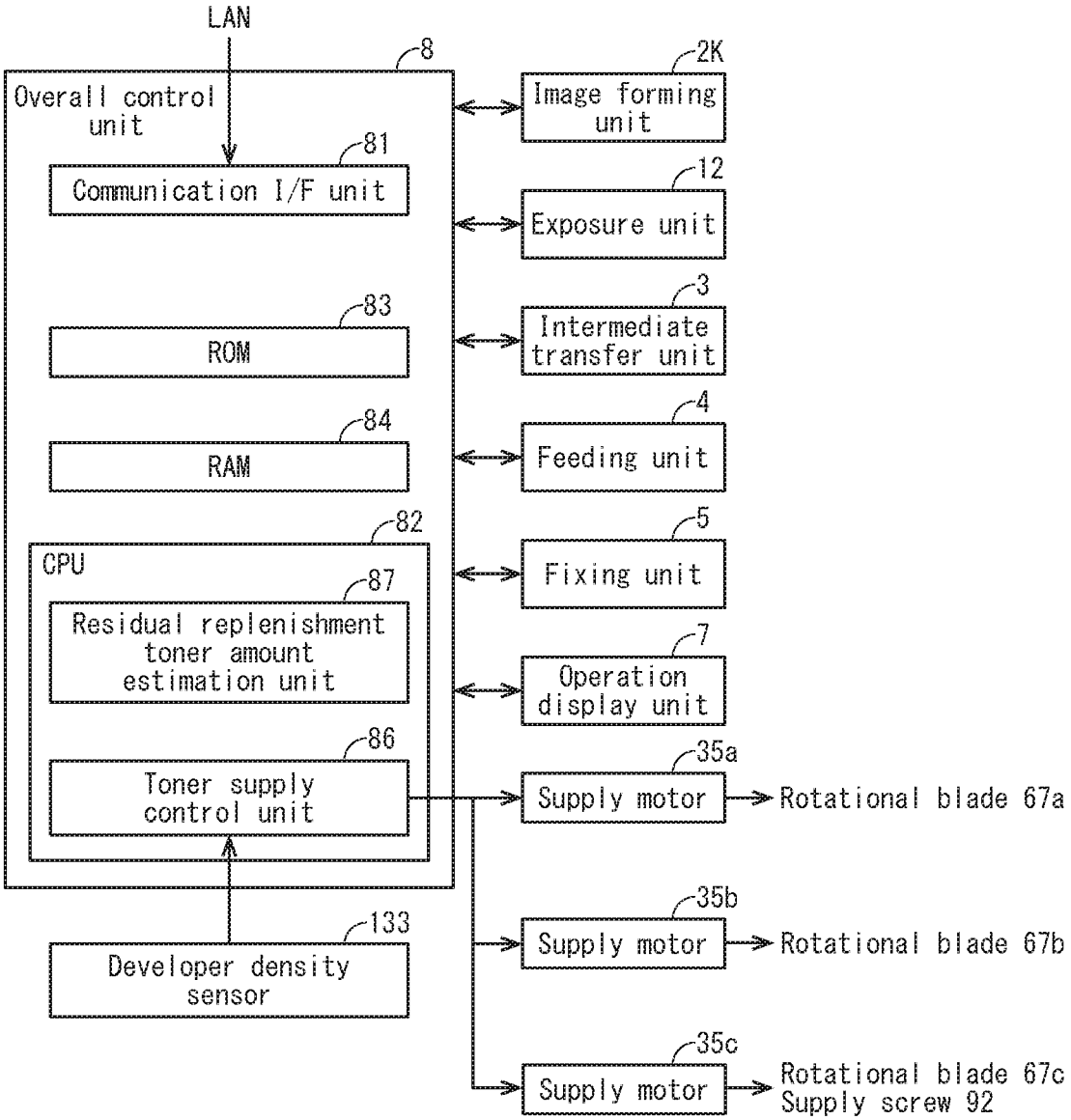
FIG. 10 is a block diagram showing the structure of an overall control unit relating to a modification.

In the present modification, a CPU 82 includes, as shown in FIG. 10, a residual replenishment toner amount estimation unit 87 which estimates a residual amount of replenishment toner currently contained in the toner supply bottle 6. Depending on the residual amount estimated by the residual replenishment toner amount estimation unit 87, the CPU 82 switches the rotation speeds of the rotational blades 67*a* to 67*c*, i.e., the rotation speeds of the supply motors 35*a* to 35*c* between high and low speeds.

Here, the residual amount of replenishment toner is estimated for example by the following estimation method. An accumulated value of toner amounts consumed in the developing unit 13 for respective print jobs executed after replacement with a new toner supply bottle 6 is managed as an accumulated toner consumed amount. A current accumulated toner consumed amount is subtracted from an initial filling amount of replenishment toner upon the replacement. A value resulting from this subtraction is determined as a current residual amount of the replenishment toner. Instead of this estimation method, any other method of acquiring the current residual amount of replenishment toner may be employed. Alternatively, a separate sensor for sensing the residual amount of replenishment toner in the toner supply bottle 6 may be provided such that the current residual amount of replenishment toner is acquired from a value sensed by the sensor.

Figure 11:
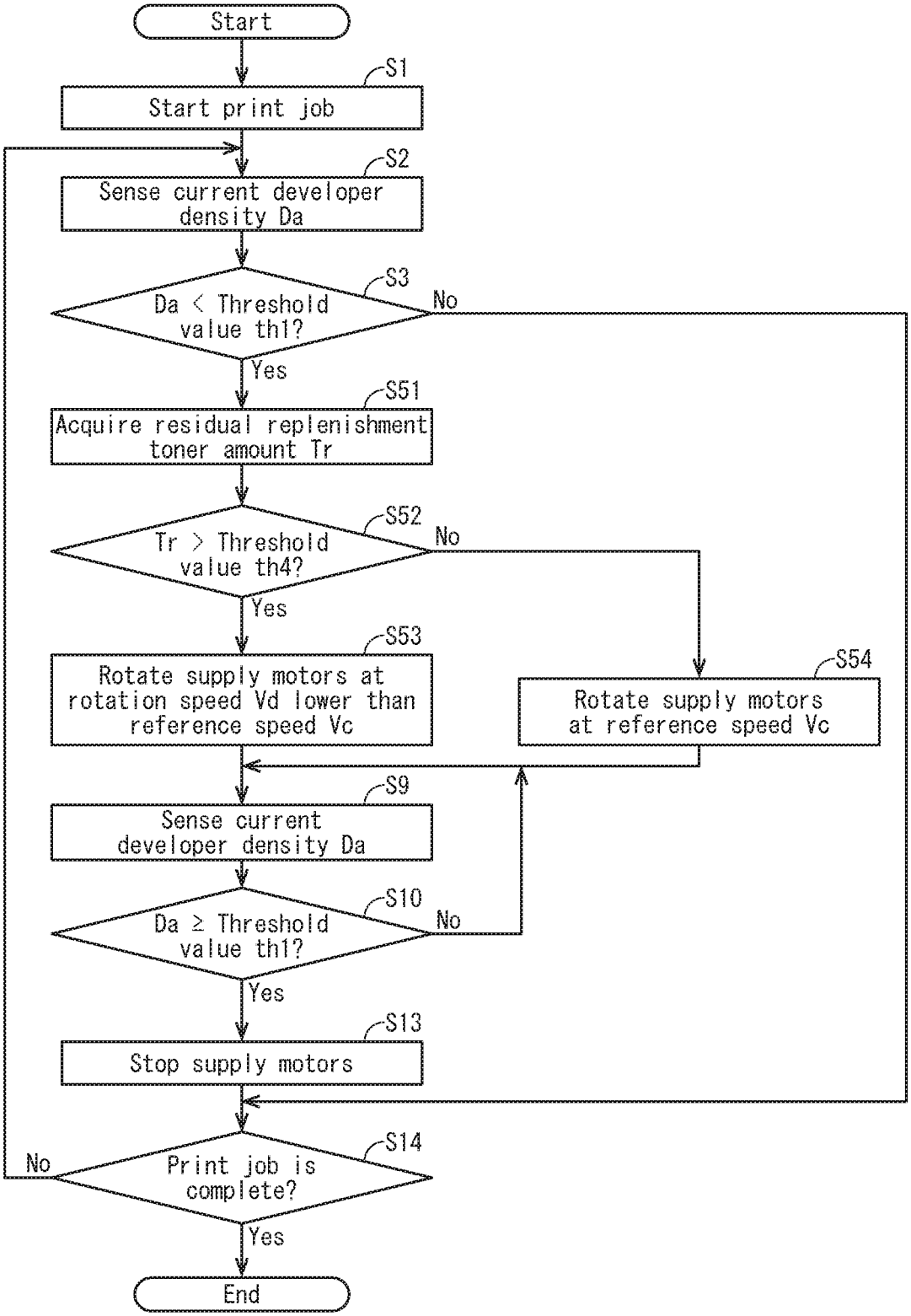
FIG. 11 is a flowchart showing operations of toner supply control relating to the modification.

FIG. 11 is a flowchart showing operations of toner supply control relating to the present modification. This flowchart is equivalent to the flowchart in FIG. 9 to which partial modification is applied. The following description focuses on the difference from FIG. 9.

As shown in FIG. 11, when judging the developer density Da<the threshold value th1 (Step S3: Yes), the toner supply control unit 86 acquires a residual replenishment toner amount Tr (Step S51). The residual replenishment toner amount Tr indicates a current residual amount of replenishment toner estimated by the residual replenishment toner amount estimation unit 87.

When judging the residual replenishment toner amount Tr>a threshold value th4 (Step S52: Yes), the toner supply control unit 86 starts driving the supply motors 35*a* to 35*c* to rotate at a rotation speed Vd (corresponding to the low rotation speed) (Step S53). The rotation speed Vd is lower than a reference speed Vc (corresponding to the high rotation speed). With this rotation, the rotational blades 67*a* to 67*c* rotate at decreased rotation speeds (the above description (a)). Then, the flow proceeds to Step S9. Here, the threshold value th4 has been preset through experiments for example, and indicates residual toner amount for judging supposition of occurrence of toner tightening. Specifically, when the residual replenishment toner amount Tr exceeds the threshold value th4, replenishment toner in the toner supply bottle 6 is supposed to tighten as described above.

Meanwhile, when judging the residual replenishment toner amount Tr≥the threshold value th4 (Step S52: No), the toner supply control unit 86 starts driving the supply motors 35*a* to 35*c* to rotate at the reference speed Vc (Step S54). With this rotation, the rotational blades 67*a* to 67*c* rotate at increased rotation speeds (the above description (b)). Then, the flow proceeds to Step S9.

In Step S9, the toner supply control unit 86 senses the current developer density Da. When judging the developer density Da≥the threshold value th1 (Step S10: Yes), the toner supply control unit 86 stops the supply motors 35*a* to 35*c* (Step S13), and the flow proceeds to Step S14. Meanwhile, when the toner supply control unit 86 judges the developer density Da<the threshold value th1 (Step S10: No), the flow returns to Step S9. In the present modification, Step S8 (measurement of the elapsed period Tp) and Steps S11 and S12 (display of the replacement message), which are performed in the above embodiment, are not performed. This is because the current residual replenishment toner amount in the toner supply bottle 6 is acquirable based on the residual replenishment toner amount Tr acquired in Step S51 and thus the replacement message is displayed upon confirmation that no residual replenishment toner remains in the toner supply bottle 6.

(5-2) In the above embodiment, to supply replenishment toner from the toner supply bottle 6 to the developing unit 13, the three rotational blades 67*a* to 67*c* are driven to rotate at the same time and the same rotation speed. However, the present disclosure is not limited to this. For example, among the three rotational blades 67*a* to 67*c* which are arranged in the belt rotation direction, a rotational blade which is far from the supply room 69 is controlled to rotate at a higher rotation speed than a rotational blade which is close to the supply room 69 such that the far rotational blade conveys a more toner amount per unit time than the close rotational blade.

Specifically, the following relation may be satisfied: the rotation speed of the rotational blade 67*a*, which is the farthest from the supply room 69>the rotation speed of the rotational blade 67*c*, which is the closest to the supply room 69. With this relation, as supply of replenishment toner progresses from the toner supply bottle 6 to the developing unit 13, an amount of replenishment toner remaining near the rotational blade 67*c* in the toner supply bottle 6, which is the closest to the supply room 69, becomes larger than an amount of replenishment toner remaining near the rotational blade 67*a* in the toner supply bottle 6, which is the farthest from the supply room 69.

This is advantageous when the total amount of replenishment toner in the toner supply bottle 6 decreases. Specifically, in the case where a more amount of replenishment toner in the toner supply bottle 6 remains near the rotational blade 67*c*, which is the closest to the supply room 69, a more amount of replenishment toner is supplied to the developing unit 13 via the supply room 69, compared with the case where a more amount of replenishment toner in the toner supply bottle 6 remains near the rotational blade 67*a*, which is the farthest from the supply room 69.

Specifically, the following relations of the rotation speeds may be employed, instead of the rotation speeds Va and Vb (>Va) of the supply motors 35*a* to 35*c* in FIG. 9. (i) When the coverage rate Cr<the threshold value th2 is satisfied, a relation Va1>Va2 may be satisfied, where Va1 represents the rotation speeds of the supply motors 35*a* and 35*b* and Va2 represents the rotation speed of the supply motor 35*c*. (ii) When the coverage rate Cr≥the threshold value th2 is satisfied, a relation Vb1>Vb2, and a relation Vb1>Va1 and Vb2>Va2 may be satisfied, where Vb1 represents the rotation speeds of the supply motors 35*a* and 35*b*, and Vb2 represents the rotation speed of the supply motor 35*c*.

Also, the following relations (i) and (ii) may be satisfied: relation (i) the rotation speed of the rotational blade 67*a*>the rotation speed of the rotational blade 67*b*=the rotation speed of the rotational blade 67*c*; and relation (ii) the rotation speed of the rotational blade 67*a*>the rotation speed of the rotational blade 67*b*>the rotation speed of the rotational blade 67*c*.

Note that the structure of setting different rotation speeds for the rotational blades 67*a* to 67*c* as above is applicable to the modification (5-1) of varying the rotation speeds of the rotational blades 67*a* to 67*c* depending on the residual replenishment toner amount Tr.

Specifically, the following relations of the rotation speeds may be employed, instead of the rotation speeds Vc and Vd (<Vc) in FIG. 11. (i) When the residual replenishment toner amount Tr>the threshold value th4 is satisfied, a relation Vd1>Vd2 may be satisfied, where Vd1 represents the rotation speeds of the supply motors 35*a* and 35*b* and Vd2 represents the rotation speed of the supply motor 35*c*. (ii) When the residual replenishment toner amount Tr≤the threshold value th4 is satisfied, a relation Vc1>Vc2 and a relation Vc1>Vd1 and Vc2>Vd2 may be satisfied, where Vc1 represents the rotation speeds of the supply motors 35*a* and 35*b*, and Vc2 represents the rotation speed of the supply motor 35*c*.

Note that instead of the above structure of rotating the three rotational blades 67*a* to 67*c*, a driving force distribution mechanism may be provided for distributing a driving force of a single motor to the rotational blades 67*a* to 67*c* for rotation.

(5-3) In the above embodiment, the exemplary structure has been described where the three rotational blades 67*a* to 67*c* are disposed inside the toner supply bottle 6. However, the number of rotational blades to be disposed is not limited to three. Any number of rotational blades may be disposed inside the toner supply bottle 6 as long as replenishment toner in the bottle body 68 is efficiently supplied to the supply room 69. For example, two or more rotational blades may be disposed, or a single rotational blade may be disposed.

In addition, the conveyance member capable of conveying replenishment toner toward the supply room 69 is not limited to the rotational blades. For example, the conveyance member conveying replenishment toner may be a conveyance screw which is disposed inside the bottle body 68 so as to be parallel to a longitudinal direction of the bottle body 68. With this structure, as a rotation speed of the conveyance screw increases, the conveyance amount of replenishment toner per unit time increases. Thus, the rotation speed of the conveyance screw is varied.

(5-4) In the above embodiment, the example of a developing system using a two-component developer has been described. Alternatively, a developing system using a monocomponent developer may be employed. In the case where a monocomponent developer is used, the total amount of toner contained in the developing unit 13 is sensed by a sensor or the like. The sensed value represents an index value indicating the amount of toner in the developer contained in the developing unit 13.

(5-5) In the above embodiment, the exemplary structure has been described where the length of the bottle body 68 in the support member direction is extended such that the left side wall 66 of the bottle body 68 in FIG. 1 (the other end opposite to the right side wall 65 which is the one end) is positioned near the driven roller 17. Alternatively, the empty region 39*b*, which corresponds to the region of the color printer where toner supply bottles for Y, M, and C colors are disposed, may be partially used as a region for disposing the toner supply bottle for K color as necessary.

For example, the length of the bottle body 68 in the support member direction may be determined, such that the left side wall 66 is positioned (i) closer to the driven roller 17 (the second support member) than the right side wall 65 of the bottle body 68 is in the belt rotation direction and (ii) distant from the image forming unit 2K in the support member direction by one to three times the length of the image forming unit 2K in the support member direction. Specifically, when the length of the image forming unit 2K in the support member direction is defined as P, one to three times the length of the image forming unit 2K falls within a range of 1×P (the length of the image forming unit 2K) to 3×P (three times the length of the image forming unit 2K as in FIG. 1), and is for example 2.5×P (two and a half times the length of the image forming unit 2K).

(5-6) In the above embodiment, the exemplary structure has been described where when a direction perpendicular to the belt rotation direction of the intermediate transfer belt 15 is defined as a belt width direction Q as shown in FIG. 2, the toner supply bottle 6 is disposed on one side of the intermediate transfer belt 15 in the belt width direction Q (the apparatus front side in the figure). Alternatively, the toner supply bottle 6 may for example be disposed on the other side of the intermediate transfer belt 15 in the belt width direction Q, namely, on the apparatus back side, or may be disposed above the intermediate transfer belt 15.

(5-7) In the above embodiment, the exemplary structure has been described where the primary transfer roller 18 is used as a primary transfer member which performs primary transfer of a toner image formed on a photoreceptor onto the intermediate transfer belt 15, and the secondary transfer roller 19 is used as a secondary transfer member which performs secondary transfer of the toner image on the intermediate transfer belt 15 onto a recording sheet S. However, the primary transfer member and the secondary transfer member are not limited to such rollers, and transfer chargers may alternatively be used for example.

Also, in the above embodiment, the exemplary structure has been described where the driving roller 16 and the driven roller 17 are respectively used as the first support member and the second support member for tensioning the intermediate transfer belt 15. Alternatively, the driven roller 17 may drive the driving roller 16. That is, one of the first support member and the second support member may drive the other.

(5-8) In the above embodiment, the exemplary structure has been described where the image forming unit 2K is disposed near the driving roller 16 outside the belt rotation path, (i) upstream of the first belt part 15*e* of the intermediate transfer belt 15, which is supported by the driving roller 16 (the first support member), in the belt rotation direction of the intermediate transfer belt 15, and (ii) downstream of the second belt part 15*d* of the intermediate transfer belt 15, which is supported by the driven roller 17 (the second support member), in the belt rotation direction.

Alternatively, the image forming unit 2K may for example be disposed outside the belt rotation path, downstream of the first belt part 15*e* in the belt rotation direction and upstream of the second belt part 15*d* in the belt rotation direction.

Also, in the above embodiment, the exemplary structure has been described where the length Ua of the intermediate transfer belt 15 in the support member direction is at least four times the length Ub of the image forming unit 2K in the support member direction. Alternatively, the length Ua may for example be at least twice the length Ub.

(5-9) In the above embodiment, the exemplary structure has been described where the supply room 69, inside which the supply screw 92 is provided, is provided onto the toner supply bottle 6. Alternatively, a structure where the supply room 69 is not provided may be employed. Specifically, the through-hole 62*a* (FIG. 2), which is provided in the bottom wall 62 of the toner supply bottle 6, may serve as the supply unit. A positional relationship between the through-hole 62*a* serving as the supply unit and the toner receiving inlet 135 of the developing unit 13 may be set such that while the toner supply bottle 6 is mounted, the through-hole 62*a* is positioned right above the toner receiving inlet 135.

(5-10) In the above embodiment, the exemplary structure has been described on a printer which forms K-color toner images as a monochrome forming apparatus employing an electronic photography system which forms toner images of a single color with use of an intermediate transfer belt. However, the present disclosure is not limited to this. For example, the present disclosure may be applicable to image forming apparatuses which form toner images of a single color other than the K color, such as copiers, facsimiles, and multiple function peripherals (MFPs). The shape, size, material, and so on of the members such as the toner supply bottle 6 and the developing unit 13 are not limited to those described above, and may alternatively be appropriately determined depending on the apparatus structure.

Moreover, the above embodiment and modifications may be combined with each other as much as possible.

Summary of Embodiment and Modifications

The above embodiment and modifications each provide one aspect for solving the problem described in the above section SUMMARY, and are summarized as follows.

The image forming apparatus according to at least one embodiment is an image forming apparatus that performs primary transfer of a toner image of a single color onto an intermediate transfer belt that is running, and then performs secondary transfer of the toner image onto a sheet, the image forming apparatus comprising: a single image forming unit that forms the toner image of the single color; a single toner supply bottle that contains replenishment toner for supply to the image forming unit; and a first support member and a second support member that are disposed inside a belt rotation path of the intermediate transfer belt, and support the intermediate transfer belt such that the intermediate transfer belt is rotatable. The image forming unit is disposed, outside the belt rotation path, closer to the first support member than the second support member in a belt rotation direction of the intermediate transfer belt. The toner supply bottle includes: a single bottle body; and a supply unit that is provided near one end of the bottle body in the belt rotation direction, and supplies the replenishment toner contained in the bottle body to the image forming unit. The other end of the bottle body in the belt rotation direction is positioned (i) closer to the second support member than the one end of the bottle body is in the belt rotation direction and (ii) distant from the image forming unit in a support member direction by one to three times a length of the image forming unit in the support member direction, the support member direction being from the first support member toward the second support member.

The image forming apparatus according to at least one embodiment may further comprise a secondary transfer member that is disposed outside the belt rotation path so as to face the first support member across the intermediate transfer belt, and performs the secondary transfer of the toner image on the intermediate transfer belt onto a sheet.

According to at least one embodiment, a first belt part and a second belt part of the intermediate transfer belt may be respectively supported by the first support member and the second support member, and the image forming unit may be disposed upstream of the first belt part in the belt rotation direction and downstream of the second belt part in the belt rotation direction.

According to at least one embodiment, the intermediate transfer belt may be kept slanted with the second belt part being higher than the first belt part.

According to at least one embodiment, the toner supply bottle may be disposed on one side of the intermediate transfer belt in a belt width direction of the intermediate transfer belt.

According to at least one embodiment, the intermediate transfer belt may have a length in the support member direction at least twice as large as the image forming unit has.

The image forming apparatus according to at least one embodiment may further comprise a conveyance member that conveys the replenishment toner contained in the bottle body toward the supply unit.

According to at least one embodiment, the conveyance member may include rotational blades that are disposed in a longitudinal direction of the bottle body, and rotate to apply a conveyance force to the replenishment toner.

The image forming apparatus according to at least one embodiment may further comprise a CPU that controls rotation of the rotational blades.

According to at least one embodiment, the CPU may acquire a coverage rate indicating an area ratio of the toner image to the sheet. When the acquired coverage rate is less than a threshold value th2, the CPU may rotate the rotational blades at a first speed. When the acquired coverage rate is equal to or larger than the threshold value th2, the CPU may rotate the rotational blades at a second speed higher than the first speed.

According to at least one embodiment, the CPU may acquire a residual amount of the replenishment toner in the toner supply bottle. When the acquired residual amount is larger than a threshold value th4, the CPU may rotate the rotational blades at a speed lower than a reference speed. When the acquired residual amount is equal to or less than the threshold value th4, the CPU may rotate the rotational blades at the reference speed.

According to at least one embodiment, the CPU separately may vary the respective rotation speeds of the rotational blades so as to rotate, among the rotational blades, a rotational blade far from the supply unit at a higher speed than a rotational blade close to the supply unit.

According to at least one embodiment, the image forming unit may include a developing unit that develops an electrostatic latent image formed on a photoreceptor by toner of the single color. The CPU may acquire an index value indicating an amount of toner in developer contained in the developing unit. When the acquired index value is less than a threshold value th1, the CPU may rotate the rotational blades. When the acquired index value is equal to or larger than the threshold value th1, the CPU may prohibit the rotational blades from rotating.

According to at least one embodiment, one of the first support member and the second support member may be a driving roller, and the other may be a driven roller.

With the above structure, since the single toner supply bottle is provided for the single image forming unit, it is unnecessary to provide separate conveyance paths for replenishment toner unlike the structure where separate conveyance paths are provided for multiple toner supply bottles. This avoids complication in apparatus structure. Furthermore, the other end of the bottle body in the belt rotation direction, which is opposite to the one end near which the supply unit is provided, is positioned (i) closer to the second support member than the one end of the bottle body is in the belt rotation direction and (ii) distant from the image forming unit in the support member direction by one to three times a length of the image forming unit in the support member direction. This increases the capacity of the former supply bottle.

Although one or more embodiments of the present invention have been described and illustrated in detail, the disclosed embodiments are made for the purposes of illustration and example only and not limitation. The scope of the present invention should be interpreted by the terms of the appended claims

What is claimed is:

1. An image forming apparatus that performs primary transfer of a toner image of a single color onto an intermediate transfer belt that is running, and then performs secondary transfer of the toner image onto a sheet, the image forming apparatus comprising:

a single image forming unit that forms the toner image of the single color;

a single toner supply bottle that contains replenishment toner for supply to the image forming unit; and a first support member and a second support member that are disposed inside a belt rotation path of the intermediate transfer belt, and support the intermediate transfer belt such that the intermediate transfer belt is rotatable, wherein the image forming unit is disposed, outside the belt rotation path, closer to the first support member than the second support member in a belt rotation direction of the intermediate transfer belt, the toner supply bottle includes:

a single bottle body; and a supply unit that is provided near one end of the bottle body in the belt rotation direction, and supplies the replenishment toner contained in the bottle body to the image forming unit, and the other end of the bottle body in the belt rotation direction is positioned (i) closer to the second support member than the one end of the bottle body is in the belt rotation direction and (ii) distant from the image forming unit in a support member direction by one to three times a length of the image forming unit in the support member direction, the support member direction being from the first support member toward the second support member, the image forming apparatus further comprises a conveyance member that conveys the replenishment toner contained in the bottle body toward the supply unit, the conveyance member includes rotational paddles that are disposed in a longitudinal direction of the bottle body, and rotate to apply a conveyance force to the replenishment toner, a CPU that controls rotation of the rotational paddles, and the rotational paddles are connected to a rotation driving source, and the CPU controls the rotation driving source so as to separately vary the respective rotation speeds of the rotational paddles and rotate, among the rotational paddles, a rotational paddle far from the supply unit at a higher speed than a rotational paddle close to the supply unit.

2. The image forming apparatus of claim 1, further comprising a secondary transfer member that is disposed outside the belt rotation path so as to face the first support member across the intermediate transfer belt, and performs the secondary transfer of the toner image on the intermediate transfer belt onto a sheet.

3. The image forming apparatus of claim 2, wherein a first belt part and a second belt part of the intermediate transfer belt are respectively supported by the first support member and the second support member, and the image forming unit is disposed upstream of the first belt part in the belt rotation direction and downstream of the second belt part in the belt rotation direction.

4. The image forming apparatus of claim 3, wherein the intermediate transfer belt is kept slanted with the second belt part being higher than the first belt part.

5. The image forming apparatus of claim 1, wherein the toner supply bottle is disposed on one side of the intermediate transfer belt in a belt width direction of the intermediate transfer belt.

6. The image forming apparatus of claim 1, wherein the intermediate transfer belt has a length in the support member direction at least twice as large as the image forming unit has.

7. The image forming apparatus of claim 1, wherein the CPU acquires a coverage rate indicating an area ratio of the toner image to the sheet, when the acquired coverage rate is less than a threshold value th2, the CPU rotates the rotational paddles at a first speed, and when the acquired coverage rate is equal to or larger than the threshold value th2, the CPU rotates the rotational paddles at a second speed higher than the first speed.

8. The image forming apparatus of claim 1, wherein the CPU acquires a residual amount of the replenishment toner in the toner supply bottle, when the acquired residual amount is larger than a threshold value th4, the CPU rotates the rotational paddles at a speed lower than a reference speed, and when the acquired residual amount is equal to or less than the threshold value th4, the CPU rotates the rotational paddles at the reference speed.

9. The image forming apparatus of claim 1, wherein the image forming unit includes a developing unit that develops an electrostatic latent image formed on a photoreceptor by toner of the single color, the CPU acquires an index value indicating an amount of toner in developer contained in the developing unit, when the acquired index value is less than a threshold value th1, the CPU rotates the rotational paddles, and when the acquired index value is equal to or larger than the threshold value th1, the CPU prohibits the rotational paddles from rotating.

10. The image forming apparatus of claim 1, wherein one of the first support member and the second support member is a driving roller, and the other is a driven roller.

11. The image forming apparatus of claim 1, wherein the rotational driving source comprises a plurality of motors.

12. The image forming apparatus of claim 1, wherein the image forming apparatus comprises a photoreceptor, and the conveyance member conveys the replenishment toner contained in the bottle body toward the supply unit in a direction horizontally perpendicular to an axis of rotation of the photoreceptor.

* * * * *